US005549400A

United States Patent [19]

Tang et al.

[11] Patent Number: 5,549,400

[45] Date of Patent: Aug. 27, 1996

[54] HIGH PRECISION DYE DONOR WEB POSITIONING IN A THERMAL COLOR PRINTER

[75] Inventors: Manh Tang, Penfield; Vlade J. Kordovich; Daniel C. Maslanka, both of Rochester, all of N.Y.

[73] Assignee: Eastman Kodak Company, Rochester, N.Y.

[21] Appl. No.: 245,990

[22] Filed: May 18, 1994

[51] Int. Cl.[6] ..... B41J 33/16

[52] U.S. Cl. ..... 400/236; 400/234

[58] Field of Search ..... 400/247, 248, 400/120.02, 120.04, 120.16, 236, 236.2

[56] References Cited

U.S. PATENT DOCUMENTS

| | | | |
|---|---|---|---|
| 4,620,199 | 10/1986 | Tatsumi et al. | 400/120.02 |
| 4,710,781 | 12/1987 | Stephenson | 346/76 PH |
| 4,739,341 | 4/1988 | Matsuno et al. | 400/248 |
| 4,893,951 | 1/1990 | Iwatani et al. | 400/236 |
| 5,137,378 | 8/1992 | Satoh | 400/120.16 |
| 5,196,862 | 3/1993 | Fisher, Sr. | 346/76 PH |
| 5,266,967 | 11/1993 | Maslanka et al. | 400/711 |

FOREIGN PATENT DOCUMENTS

| | | | |
|---|---|---|---|
| 0159673 | 10/1985 | European Pat. Off. | B41J 3/20 |
| 63-179778 | 7/1988 | Japan | 400/236 |
| 03-204174 | 9/1991 | Japan | 400/236 |
| 2182610 | 5/1987 | United Kingdom | B41J 35/08 |
| 2202492 | 2/1988 | United Kingdom | B41J 34/18 |

*Primary Examiner*—David A. Wiecking
*Attorney, Agent, or Firm*—Milton S. Sales

[57] ABSTRACT

A thermal printer includes a web transport for positioning a dye donor web along a path; a sensor along the path and spaced from the print line for detecting the arrival of a leading edge of a dye frame, and a control for the web transport. The control is adapted to reposition the dye donor web along the path so that the leading edge of the dye frame is in substantial alignment with the print line before printing the dye frame begins. The web transport moves the dye donor web in both forward and reverse directions past the print line, and the sensor detects the leading edge of a frame while the donor web moves in a forward direction. The control stops the web and reverses it to thereby rewind the dye donor web until the edge of the dye frame is in substantial alignment with the print line. The control adjusts the amount of repositioning of the dye donor web that is effected as a function of the detected leading edge's location along dye donor web.

1 Claim, 5 Drawing Sheets

| THREE-FRAME SERIES | SUPPLY RADIUS | $RES_X$ | YELLOW FRAME QCOUNTS | COUNTS TO MOVE | | |
|---|---|---|---|---|---|---|
| | | | | RETRACT | LOAD | DOWN |
| | | | | | | |
| 0 | 0.867000 | 367 | 4351 | 416 | 436 | 465 |
| 10 | 0.845921 | 376 | 4459 | 427 | 447 | 476 |
| 20 | 0.824303 | 386 | 4576 | 438 | 459 | 489 |
| 30 | 0.802103 | 397 | 4703 | 450 | 471 | 502 |
| 40 | 0.779271 | 408 | 4840 | 463 | 485 | 517 |
| 50 | 0.755749 | 421 | 4991 | 478 | 500 | 533 |
| 60 | 0.731472 | 435 | 5157 | 493 | 517 | 551 |
| 70 | 0.70636 | 451 | 5340 | 511 | 535 | 571 |
| 80 | 0.680322 | 468 | 5544 | 531 | 556 | 592 |
| 90 | 0.653247 | 487 | 5774 | 553 | 579 | 617 |
| 100 | 0.625000 | 509 | 6035 | 578 | 605 | 645 |

FIG. 7

HIGH PRECISION DYE DONOR WEB POSITIONING IN A THERMAL COLOR PRINTER

CROSS-REFERENCE TO RELATED APPLICATIONS

Reference is made to commonly assigned, co-pending U.S. patent application Ser. No. 8/022,202 filed in the name of James A. Whritenor on Feb. 25, 1993.

BACKGROUND OF THE INVENTION

1. Technical Field

The present invention relates generally to color thermal printing, and, more particularly, to an apparatus and method for positioning a dye donor web relative to the print head with high precision for minimal waste.

2. Background Art

In a color thermal printing process, the finished print is made by successively transferring yellow, magenta, and cyan dyes from respective dye patches of a dye donor web onto a dye receiver medium. In one type of color thermal printer, such as disclosed in commonly assigned U.S. Pat. No. 4,710,781 which issued to Stanley W. Stephenson on Dec. 1, 1987, a dye donor web contains a repeating series of frames of different colored, heat transferable dyes. The dye donor web is disposed between a receiver medium, such as coated paper and a print head formed of a plurality of individual resistive heating elements. When a particular heating element is energized, its heat causes dye from the donor web to transfer to the receiver medium.

Conventionally, the yellow frame is first positioned under the print head with the receiver medium. As they are advanced, the heating elements are selectively energized to form a yellow dye image on the receiver medium. Next, the magenta frame and the receiver medium are moved under the print head. Both the receiver medium and the magenta frame are moved as the heating elements are selectively energized, whereby a magenta dye image is formed, superimposed upon the yellow image. This process is repeated for the remaining frames of the series, such that a multi-color image is formed on the receiver medium.

During the color printing process, it is necessary to have the dye donor web properly positioned relative to the dye receiver medium to ensure full coverage of the image area by successive color frames. Since the donor web has a repeating series of different colored dye frames, it is necessary to identify the leading edge of each different frame of each series. One way to do this is to provide index marks on the donor; one type of mark for the yellow frame (the first frame of each series) and a different type of mark for the other color frames.

Another way to identify the frames is disclosed in above-identified Stephenson patent, wherein color discriminating optical sensors are located directly in the donor web path just past the print line of the thermal print head in the direction of travel of the donor web. These sensors detect the presence of different colored patches on the donor as they advance. A beam of red light and a beam of yellow light are passed through the donor web near to the print head. Respective photodetectors measure the intensity of the beams passing through the web. The particular dye frame can be identified by analyzing the two light beams because of transmission differences of the color dyes. When the sensors detect a new color frame during the printing cycle, the donor web advance is stopped.

In the system of the Stephenson patent, it is desirable to position the sensors as close as possible to the print line of the thermal print head because donor web that occupies that distance after positioning is not used in printing, and is therefore wasted. Unfortunately, the physical configuration of the print head and surrounding mechanisms limit the minimum distance that can be achieved. This, in turn, limits the minimum size of the color frames. Among the consequences of having unused donor are: a higher cost of materials for making prints, reduced donor web capacity in the printer, and a greater volume of material requiring environmentally safe disposal after use.

Accordingly, it will be appreciated that it would be highly desirable to have a thermal printer in which the amount of dye donor web that is wasted by inability to locate the sensor at the print line of the thermal print head is minimized. In commercially-available printers of the type described in the Stephenson patent, the problem of donor web waste as set forth above is partially overcome by rewinding the donor after the leading edge of a color frame is sensed. A motor on the donor web supply spool is programmed to rotate the supply spool through a predetermined arc length in the reverse-feed direction to draw the web backwards; returning the leading edge of the color patch toward the print line of the thermal print head. However, since the distance of web travel is not only a function of the amount of supply spool rotation, but also a function of supply roll diameter, the amount of rotation of the supply roll must be determined for a full supply roll. Thus, operation with anything other than a full supply roll still results in additional dye donor web waste.

DISCLOSURE OF THE INVENTION

It is an object of the present invention to overcome the problem of dye donor waste as set forth above.

According to one aspect of the present invention, a thermal printer with donor sensors positioned relative to the thermal print head as described in the Stephenson patent, includes a system for retracting the donor web by a predetermined distance so that the start of the color frame is closely aligned with the print line of the thermal print head.

According to another aspect of the present invention, a thermal printer includes a web transport for positioning a dye donor web along a path, a sensor along the path and spaced from the print line for detecting the arrival of a leading edge of a dye frame, and a control for the web transport. The control is adapted to reposition the dye donor web along the path so that the leading edge of the dye frame is in substantial alignment with the print line before printing the dye frame begins.

In a preferred embodiment, the web transport moves the dye donor web in both forward and reverse directions past the print line. The sensor detects the leading edge of a frame while the donor web moves in a forward direction, and the control stops the web and reverses it to thereby rewind the dye donor web until the edge of the dye frame is in substantial alignment with the print line. Preferably, the control adjusts the amount of repositioning of the dye donor web that is effected as a function of the detected leading edge's location along dye donor web.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 7 is a chart of calculated values determined in accordance with the illustrated embodiment of the present invention.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art. While the invention is described below in the environment of a resistive head thermal printer, it will be noted that the invention can be used with other types of printing apparatus using dye donor webs of the type described.

Figure 1:
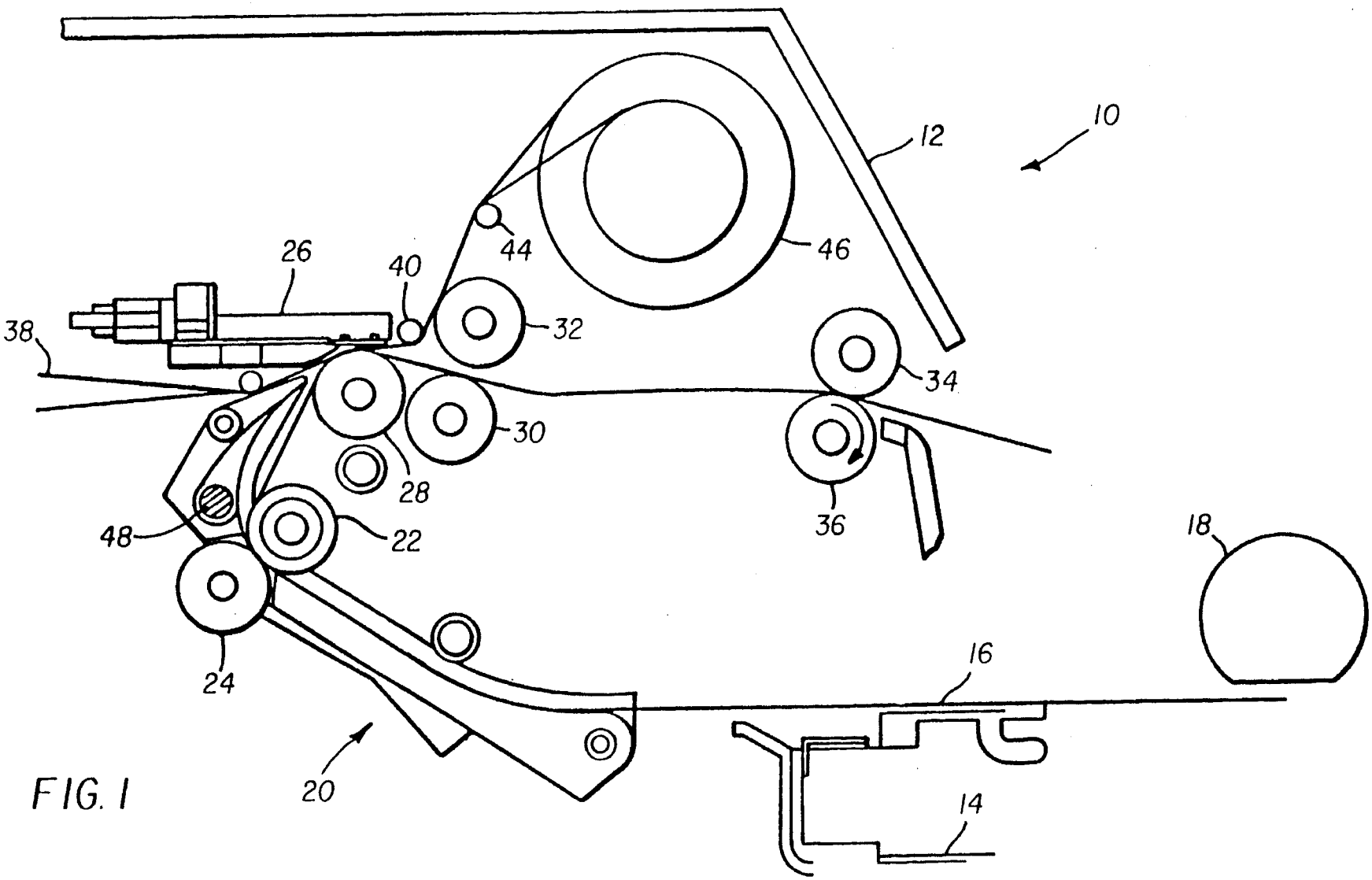
FIG. 1 is a diagrammatic side view of a thermal printer illustrating an initial receiver medium of media loading path.
Figure 2:
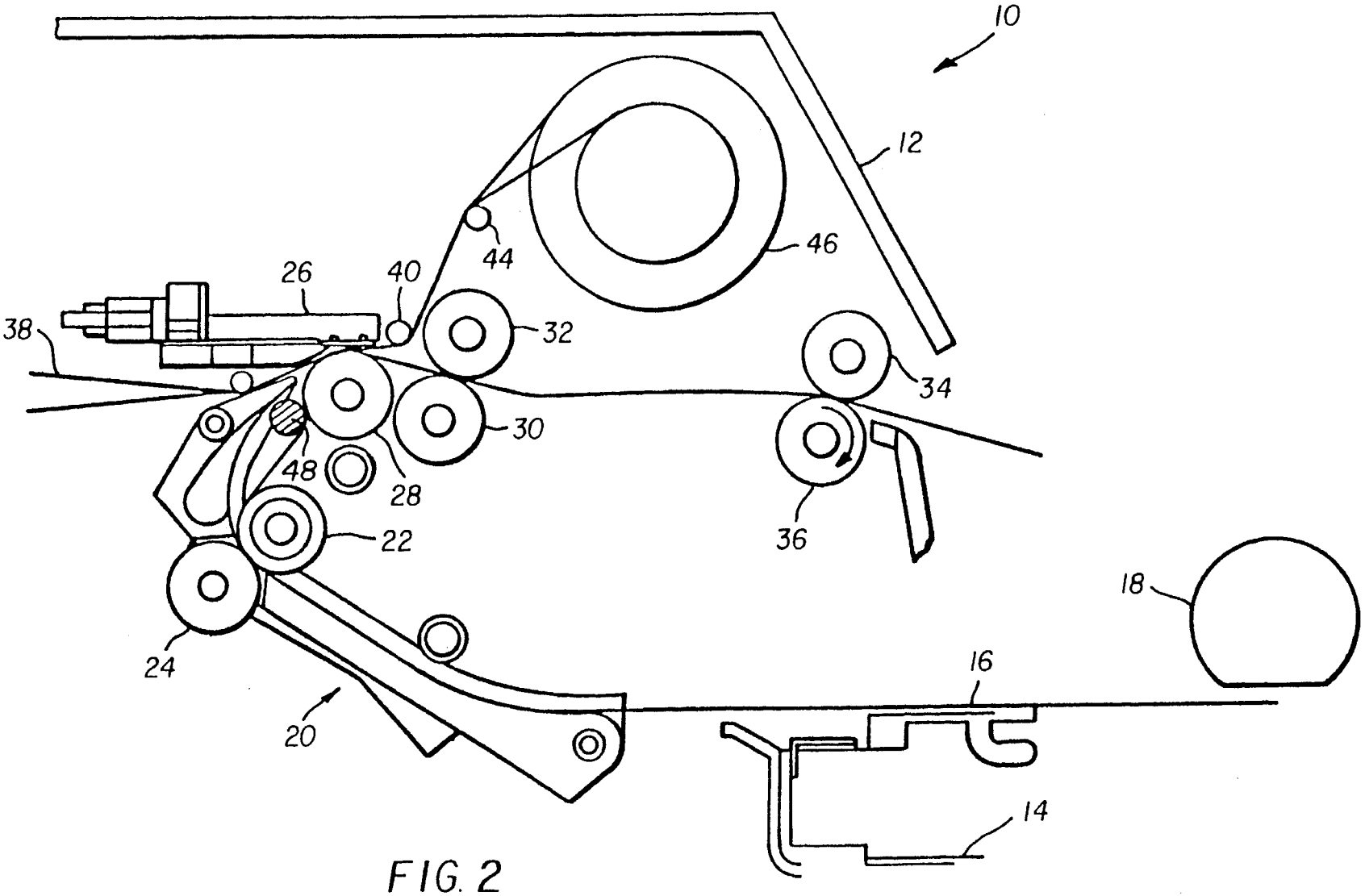
FIG. 2 is a side view similar to FIG. 1, but illustrating a second, unguided, media transport path.

Referring to FIGS. 1 and 2, a thermal printer 10 is illustrated with a cover 12 and a paper tray 14 as a source of dye receiver medium. A 20 dye receiver medium 16, which in the illustrated embodiment is a sheet of paper or transparency material, is urged from paper tray 14 by a picker mechanism such as a D-shaped picker roller 18. Picker roller 18 urges receiver medium 16 into a paper guide assembly 20 where the receiver medium is engaged by secondary motion rollers 22 and 24 that urge it along paper guide assembly 20 to the nip area between a print head 26 and a platen roller 28. Upon exiting the nip area between the print head and the platen roller, receiver medium 16 goes to the nip between a capstan roller 30 and a capstan pinch roller 32. As illustrated, receiver medium 16 exits the thermal printer through exit rollers 34 and 36.

In the print head area, printing occurs when dye from a dye donor web 38 is transferred onto receiver medium 16. Upon exiting the nip area of the print head, donor web 38 passes over an idler roller 40 and then over a second idler roller 44 to a donor take-up spool 46. A platen pinch roller 48 works in concert with platen roller 28, as explained in further detail below. Various ones of the illustrated rollers and capstans are motor driven, as referred to herein. For clarity, many of the motors are not illustrated in the accompanying drawings, and their and choice and positioning are well within the design ability of ones skilled in the thermal printer art. Such motors may be referred to throughout this specification without numeral by reference to their effect on the driven roller or capstan.

Figure 3:
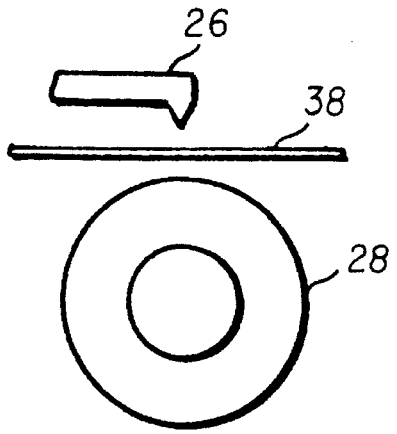
FIG. 3 is a diagram illustrating the print head and platen at the first, non-printing position for loading the dye donor.
Figure 4:
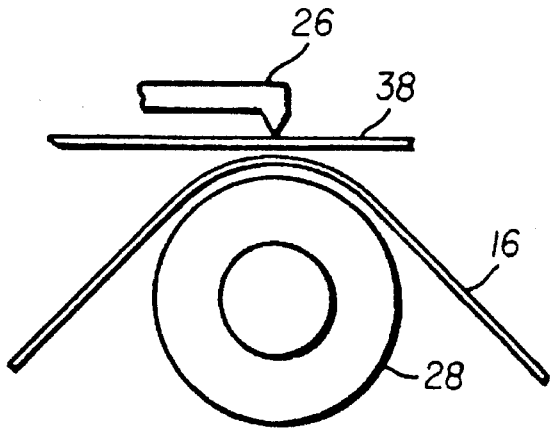
FIG. 4 is a diagram similar to FIG. 3, but illustrating the print head and platen at the second, non-printing position for loading the dye receiver medium.
Figure 5:
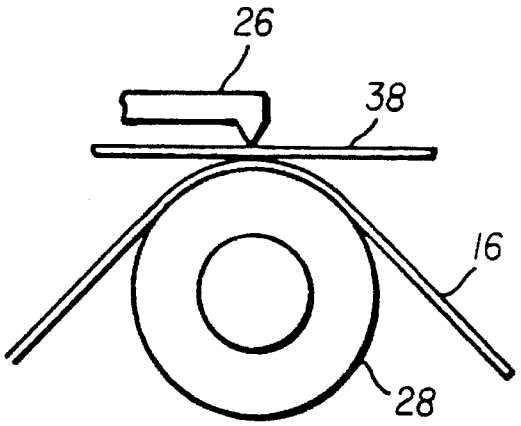
FIG. 5 is a diagram similar to FIGS. 3 and 4, but illustrating the print head and platen at the printing position.

Referring to FIGS. 3–5, print head 26 is preferably a three position print head that moves between (a) a fully opened position (FIG. 3) where print head 26 is spaced a pre-selected distance from platen roller 28 so that donor web 38 clears the platen roller by a pre-selected amount; (b) an intermediate "receiver medium load" position (FIG. 4) where the print head is spaced an intermediate distance from platen roller 28; and (c) a print position (FIG. 5) at which print head 26 loads donor 38 and receiver medium 16 against platen roller 28 for printing.

Capstan pinch roller 32 is preferably movable relative to capstan roller 30 between an open position (FIG. 1) and a closed position (FIG. 2). At the closed position, the capstan. pinch roller and the capstan roller grip dye receiver medium 16 there between for metering the dye receiver medium. At the open position, capstan roller 30 and capstan pinch roller 32 are spaced one from the other so that receiver medium can move freely between the rollers.

Platen pinch roller 48 is preferably movable between a printing position (FIG. 2) at which the platen pinch roller is in contact with platen roller 28 to hold dye receiver medium 16 against the platen roller, and a non-printing position at which pinch roller 48 is spaced from platen roller 28. At the non-printing position, platen pinch roller 48 is moved away from platen roller 28 so that it holds receiver medium 16 in paper guide 20 to prevent scratching during the initial loading sequences of the cycle.

Platen pinch roller 48 is positioned to move receiver medium 16 away from paper guide 20 and towards platen roller 28 during movement from the non-printing position to the printing position. This prevents scratching of the receiver medium during the printing sequences.

The print head at the print position creates a pre-selected amount of drag on receiver medium 16 so that a portion of the receiver medium between the print head and the nip between capstan roller 30 and capstan pinch roller 32 is uniformly tensioned for each print pass.

Operation of the illustrated embodiment of the present invention will now be described by referring to FIGS. 1–5. During initialization, print head 26 is at its fully opened (FIG. 3) position. Platen pinch roller 48 and capstan pinch roller 32 are open. The receiver medium loading sequence begins with print head 26 located away from platen roller 28. This releases dye donor web 38 from any clamping pressure and leaves a gap between print head 26 and platen roller 28. A sheet of dye receiver medium 16 is picked from supply tray 14 and directed into guide assembly 20, which guides dye receiver medium 16 to secondary motion rollers 22 and 24. The secondary motion rollers then urge the dye receiver medium to the gap between print head 26 and platen roller 28.

As the leading edge portion of receiver medium 16 exits the gap between the print head and the platen roller, the receiver medium transport path further guides the receiver medium to the receiver medium drive mechanism that includes capstan roller 30 and pinch roller 32. As receiver medium 16 approaches the receiver medium drive mechanism, pinch roller 32 moves away from capstan roller 30, forming a second gap. When dye receiver medium 16 passes through the second gap and is in the proper position, pinch roller 32 engages and presses dye receiver medium 16 firmly between the receiver medium drive mechanism rollers 30 and 32.

The receiver medium is now moved by a stepper motor, not shown, rotating the capstan rollers until the trailing edge of the receiver medium is sensed by a sensor, not shown. The movement is stopped and the number of motor pulses required to move the receiver medium this distance will indicate the length of the receiver medium. This length will be compared to the image length to be printed or the sheet length originally selected.

The receiver medium loading sequence is followed by advancing dye donor web 38 to the beginning of the first color patch of the next series of frames, where dye patch sensors detect the beginning of the next color patch, as explained in greater detail below. If the next color patch is not detected by the time the receiver medium is properly positioned for printing, then the dye donor advances until the leading edge of the first color patch of the next sequence is located. Printing of the image then occurs, followed by print ejection.

Staging just prior to each print pass is another part of the dye receiver medium movement. When the receiver medium is sensed at the capstan area during forward movement, the movement is reversed for a short distance. The thermal print head is lowered and the receiver medium is moved forward by the capstan rollers to the first print line position. The print head creates a drag so that the section of receiver medium between the print head and the capstan roller nip is under the same tension for each cycle. This insures good color registration, as well as consistent density so that there are no dark or light bands caused by inconsistent tension.

Once the capstan pinch rollers are closed, the platen idler roller moves the dye receiver medium away from the entrance feed path to prevent scratches while the receiver medium is moving back and forth. It can then be moved into position on the platen roller to define the unguided print path.

There are three cycles of operation. During the first of the three cycles, the print head moves to its fully opened position illustrated in FIG. 3. A sheet of receiver medium is picked by D-shaped picker roller 18 to urge the sheet along the sheet guide in a first path. The platen motor, not shown, turns on, and the sensor detects the leading edge of the receiver medium sheet and verifies the pick. When the leading edge is sensed at the capstan area, the platen motor turns off and the capstan closes; thereby closing the pinch. The print head next moves to the intermediate position shown in FIG. 4 and the capstan motor turns on forwardly for staging the receiver medium sheet. The trailing edge of the sheet is then sensed. The capstan motor is turned off in the forward direction and turned on in the reverse direction, and the platen motor is turned on in the reverse direction. When the lead edge of the receiver medium sheet is sensed again, the platen and capstan motors are turned off.

Now, the donor is advanced to the first color patch, (say, yellow) with both a donor-supply motor 54 and a donor take-up motor 66 (illustrated in FIG. 6) turned ON. Once the first color patch is sensed (as will be explained hereafter), the supply motor is turned off while the capstan take-up motor is left on. By operating both the stepper and platen motors, the capstan is rewound by a given number of pulses to reverse the direction of movement of the receiver sheet medium. Moving the print head to its print position shown in FIG. 5 and advancing the receiver medium sheet by the given number of pulses are the final printing preparations. Printing now begins. The leading edge of the receiver medium sheet is sensed at the exit indicating printing is proceeding as desired. The stepper stops at the proper printing length, and the head moves to the fully opened position shown in FIG. 3 completing the first cycle.

The second of the three cycles advances the dye donor web to the second color (say, magenta) with both donor-supply motor 54 and donor take-up motor 66 turned ON. When the second color is sensed (again, as will be explained hereafter), the supply motor turns off, and the second of the three cycles continues as in the first cycle. The stepper stops at the proper printing length, and the print head moves to its FIG. 3 position; completing the second cycle.

The third of the three cycles advances the donor to the third color (say, cyan) with both donor-supply motor 54 and donor take-up motor 66 turned ON. When the third color is sensed, the supply motor turns off, as with yellow and magenta, and the third cycle continues as in the first and second cycles. The stepper stops at the proper printing length, and the print head moves to its FIG. 3 position. Now, forward motion of the receiver medium sheet continues until the edge sensor senses the trailing edge of the receiver medium sheet. The capstan is opened. The stepper continues until a sensor senses the trailing edge at the exit thereby completing the third cycle.

Figure 6:
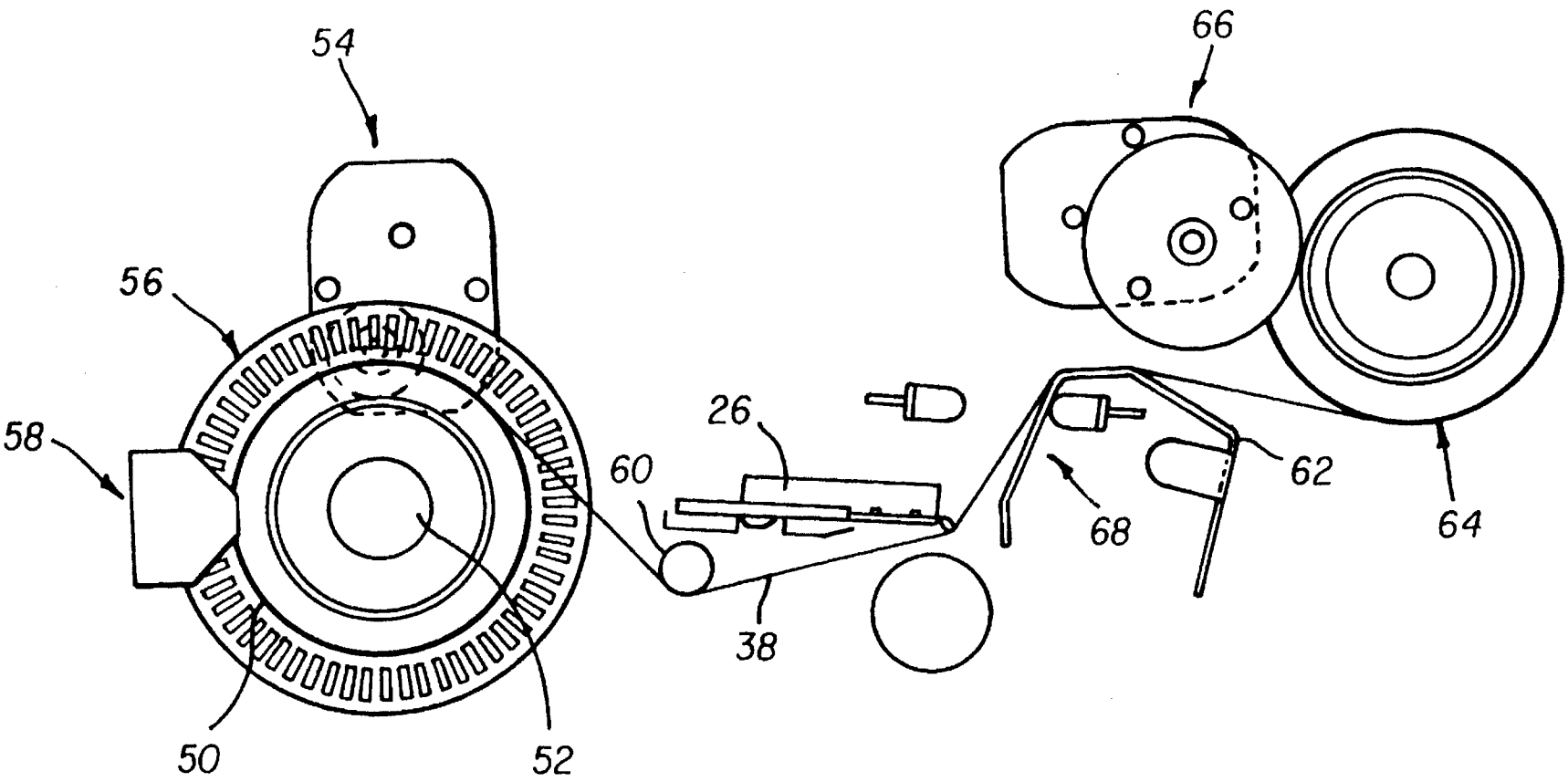
FIG. 6 is a diagrammatic side view of a thermal printer according to a second embodiment illustrating the dye donor web drive mechanism.

Details of the dye donor web positioning apparatus will now be explained with reference to FIG. 6. A supply roll 50 of dye donor web 38 is mounted on a spindle 52 which is driven in a counterclockwise direction, as illustrated, by a bi-directional donor-supply motor 54 to retract the donor web. An encoder wheel 56 rotates with spindle 52 so that a series of encoder marks on the wheel can be detected by an encoder sensor 58. An electrical pulse signal from sensor 58 is inputted to a controller, not shown, for donor-supply motor 54.

Dye donor web 38 is trained about an idler roller 60, print head 26, a web guide 62, a take-up roll 64 mounted on a spindle 64 which is driven in a counterclockwise direction, as illustrated, by a donor take-up motor 66 to advance the donor web.

During the color printing process, it is necessary to have the dye donor web properly positioned relative to the dye receiver medium. This need has been met by placing a color discrimination system 68 directly in the dye donor path just past the thermal print head in the direction of travel of the donor web. The color discrimination system detects the presence of different colored frames on the donor web as the web advances. When the color discrimination system detects a new color frame during the printing cycle, donor advance by motors 54 and 66 is stopped. Full details of the color discrimination system can be found in the above-mentioned Stephenson patent, and details of the general donor web and receiver medium positioning system can be found in commonly assigned, co-pending U.S. patent application Ser. No. 08/022,202 filed in the name of James A. Whritenor on Feb. 25, 1993, the disclosures of which are hereby specifically incorporated herein by reference.

It is desirable to position color discrimination system 68 as close as possible to the print line of the thermal print head because all donor web that occupies that distance after positioning is not used in printing, and is therefore wasted. Unfortunately, the physical configuration of the print head and the surrounding mechanisms limit the minimum distance that can be achieved. Thus, the need for retracting the donor web a predetermined distance according to the present invention. As used herein, the phrase "print line" is not intended to strictly define a single line of printing elements, as print heads are commonly constructed with staggered printing elements.

After it has been initially positioned by the color discrimination system, the action of retracting the dye donor web a predetermined distance is accomplished by simultaneously (i) energizing donor take-up motor 66 in the reverse direction to supply slack in the donor web and (ii) energizing donor-supply motor 54 to rewind the dye donor web. As the web is rewound, control software counts the pulses generated by encoder sensor 58. After a predetermined number of pulses have been sensed, donor-supply motor 54 is de-energized, and the start of the dye frame is now closely aligned with the print line.

Unfortunately, dye donor supply roll 50 and take-up roll 64 undergo significant changes in diameter as the donor web is expended in the printing process. Thus, the number of encoder counts required to move the start of a color frame from color discrimination system 68 to the print line will be different, depending upon the changing diameter of supply roll 50, as the donor is being rewound onto the supply roll.

This difficulty is overcome according to a feature of the present invention. Each time that the printer is initialized, an entire color frame of known length is transported past the color discrimination system 68 in its entirety. The machine control software counts the number of encoder pulses at supply roll 50 as the color frame passes from its beginning to its end past the color discrimination system. Since the number of encoder counts per revolution is known, the current dye donor supply roll diameter is now mathematically determinable, as is the number of encoder counts which will be required to retract the color frames from the color discrimination system to the print line.

Also known are the thickness of donor web 38, the minimum diameter of supply roll 50, and the lengths of all color frames on the donor web. Therefore, once the printer is initialized and the supply spool diameter is known, software can readily be used to monitor the roll diameter decrease as donor web is expended during printing. Consequently, the number of encoder pulses required for donor retraction can be updated as frequently as required to compensate for the changing diameter.

The following example illustrates the procedure in the context of one commercially-available thermal printer having the following measured parameters:

- Empty supply roll radius, $R_i$=0.625 inches;
- Full supply roll radius, $R_o$=0.867 inches;
- Number of prints per roll, N=100;
- Length of a 3-frame series, L=35.85 inches;
- Length of Yellow frame, $L_y$=11.85 inches;
- Encoder resolution=500 pulses/revolution;
- Distance from print line to sensors with print head retracted=1.234 inches;
- Distance from print line to sensors with print head in load position=1.288 inches; and
- Distance from print line to sensors with print head down=1.366 inches.

From these measured values, we have calculated the following parameters:

- Donor web thickness, t=0.000316 inches was determined from the equation:

$$t=\pi(R_o^2-R_i^2)/N*L;$$

- Quadrature counts per revolution, qcount=2,000 was determined by multiplying the encoder resolution of 500 pulses per revolution by four (quadrature decoding techniques are well known means for increasing resolution by four);
- Count resolution (inner), $RES_{in}$=0.001963 inches/qcount was determined from the equation:

$$RES_{in}2\pi R_i/qcount;$$

and

- Count resolution (outer), $RES_{out}$=0.002724 inches/qcount was determined from the equation:

$$RES_{out}=2\pi R_o/qcount.$$

Referring to the chart which makes up FIG. 7, we have shown values for each of ten regions on the dye donor web supply roll. In practice, one can divide the supply roll into any number of regions depending on memory availability and resolution required.

In the FIG. 7 chart, for each series X (X=0 to N, where N=100 in the illustrated example) of three frame series on the donor web the supply roll:

- diameter, R, is determined from the equation:

$$R=\{[t*L(N-X)/\pi]+R_i^2\}^{1/2};$$

- Quadrature counts per inch, $RES_X$, was determined from the equation:

$$RES_X=qcount/2\pi R;$$

- Quadrature counts for each yellow patch was determined from the equation:

$$L_y*RES_X;$$

and

- The number of encoder counts which will be required to retract the color frames from the color discrimination system to the print line, for each of the three print head positions, was determined by multiplying $RES_X$ (quadrature counts per inch) by the difference between the distance from heat line to color sensors and the desired top border.

From the above description, it will be appreciated that secondary positioning of the donor web allows the use of the minimum amount of web material to create thermal prints. This results in the lowest material costs for both producer and consumer, maximizing the donor capacity in the printer, and minimizing the volume of material requiring environmentally good disposal after use.

While the invention has been described with particular reference to a preferred embodiment, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

For example, the invention has been described with reference to a sheet feed thermal. printer, it is apparent that the staging is easily adapted to printers that are fed by a continuous receiver medium web. Also, the illustrated embodiment employs color sensors located beyond the thermal print head in the direction of donor advance, and retracts the initially positioned color frames to the print line. An alternative to this technique is to locate the sensors on the opposite side of the thermal print head, and, after initially sensing the start of a color patch, to advance the donor a predetermined number of encoder pulses to relocate it proximal to the print line.

As is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A thermal printer having a print head defining a print line, and a web supply adapted to receive a dye donor web roll having a plurality of dye frames in a repeating series of different colors; said printer comprising:

a web take-up drive adapted to move a dye donor web along a path past the print line in a forward direction away from the web supply;

sensor means, along the donor web path and spaced from the print line, for detecting the arrival of a leading edge of a driven dye frame at the sensor means;

a web supply drive adapted to rotate a received roll through a predetermined angle in a direction to move the dye donor web along the path past the print line in a reverse direction toward the web supply to reposition the dye donor web along the path upon said sensor means detecting the arrival of the said leading edge at the sensor means, and before printing with the give dye frame, so that the leading edge of the given dye frame is in substantial alignment with the print line before printing the given dye frame begins;

a control means for adjusting the predetermined angle in accordance with the instantaneous diameter of the received roll such that the amount of dye donor web moved past the print line in the reverse direction is substantially constant; and means for supplying slack in the dye donor web between the web take-up drive and the print head by using the web take-up drive to move the dye donor web in the reverse direction before the web supply drive rotates the received roll to move the dye donor web in the reverse direction.

* * * * *

UNITED STATES PATENT AND TRADEMARK OFFICE

CERTIFICATE OF CORRECTION

PATENT NO. : 5,549,400
DATED : August 27, 1996
INVENTOR(S) : Manh Tang, et al

It is certified that error appears in the above-indentified patent and that said Letters Patent is hereby corrected as shown below:

Title page, item [56], under "References Cited"
Foreign Patent Documents, "03-204174" should read --03-205174--.

Signed and Sealed this

Third Day of December, 1996

Bruce Lehman

*Attest:*

BRUCE LEHMAN

*Attesting Officer*

*Commissioner of Patents and Trademarks*